United States Patent [19]

Bailey

[11] 4,392,548

[45] Jul. 12, 1983

[54] SPEAKER ENCLOSURE AND METHOD OF PRODUCING SAME

[75] Inventor: Gary C. Bailey, Burbank, Calif.

[73] Assignee: Engineering Development Company, Burbank, Calif.

[21] Appl. No.: 206,471

[22] Filed: Nov. 13, 1980

[51] Int. Cl.[3] ..... H04R 1/20

[52] U.S. Cl. ..... 181/156; 181/152; 181/155; 179/181 F; 179/1 E

[58] Field of Search ..... 179/181 F, 1 E, 1 GA; 181/152, 153, 155, 156

[56] References Cited

U.S. PATENT DOCUMENTS

| | | | |
|---|---|---|---|
| 2,757,751 | 4/1952 | Tavares | 181/31 |
| 2,905,260 | 2/1955 | Williams | 181/32 |
| 3,912,866 | 10/1975 | Fox | 179/1 E |
| 3,962,544 | 6/1976 | Kobayashi | 179/1 E |
| 4,057,689 | 11/1977 | Stallings | 179/1 E |

FOREIGN PATENT DOCUMENTS

| | | | |
|---|---|---|---|
| 42-5105 | 5/1967 | Japan | 181/163 |
| 55-95496 | 7/1980 | Japan | 179/181 |

OTHER PUBLICATIONS

Leonard Feldman, Third Channel, Radio & TV News, Mar. 1959, p. 105.

*Primary Examiner*—A. D. Pellinen
*Assistant Examiner*—R. G. Lev
*Attorney, Agent, or Firm*—Marvin H. Kleinberg

[57] ABSTRACT

An improved speaker enclosure apparatus re-radiates biphase sound emanating from a speaker supported therein. When connected to receive a differential sound signal, the sound produced complements the direct sound radiating from "right" and "left" speakers. The enclosure is of compliant material, such that at low frequencies the entire enclosure expands and contracts with the expansion and contraction of the speaker diaphragm, responsive to volume expansion and contraction of the air enclosed in the enclosure. At high frequencies, only thinned portions of the enclosure expand and contract, responsive to the higher frequency sound wavefronts emanating from the speaker. The ability to mold the enclosure and the thinned portions provides a method of controlling the radiated wavefront to a desired shape to be propagated into the listening environment.

9 Claims, 8 Drawing Figures

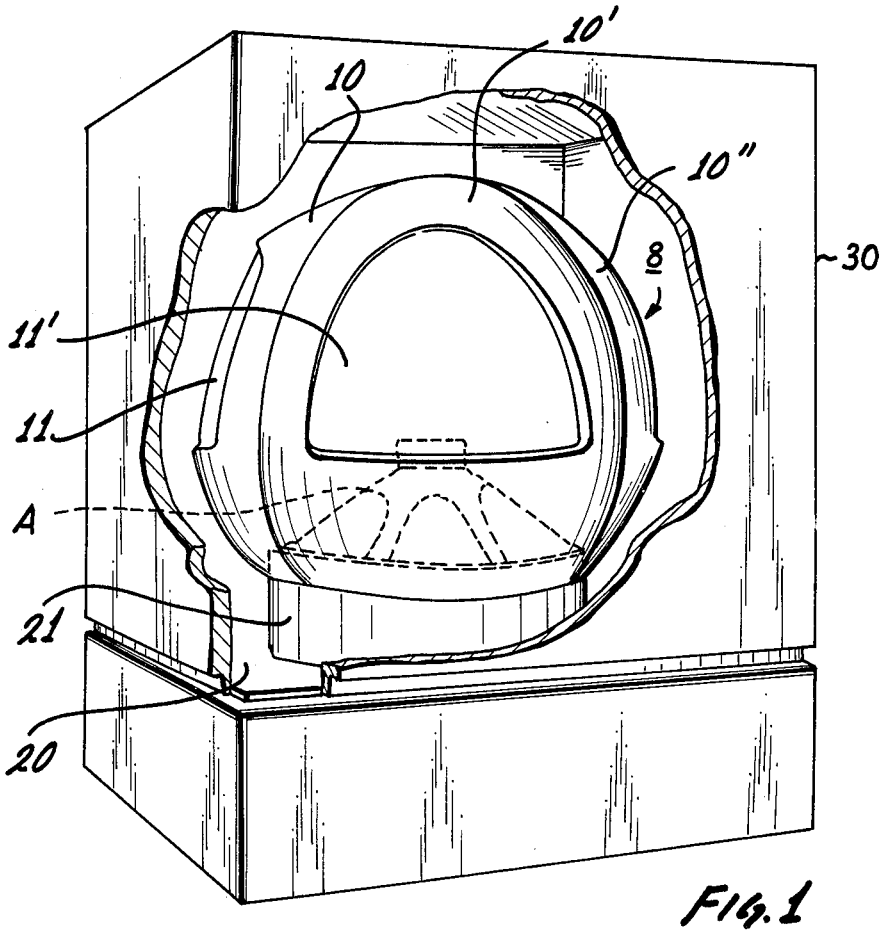
FIG. 1
FIG. 5
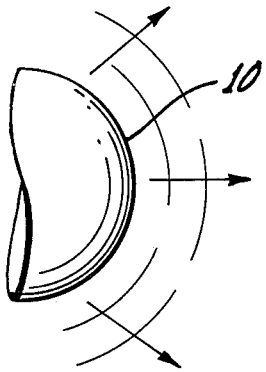
FIG. 6
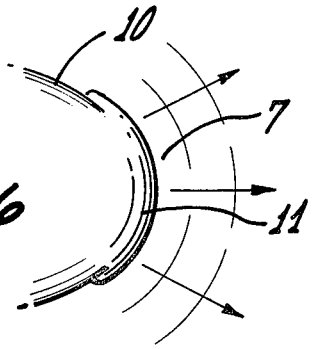

SPEAKER ENCLOSURE AND METHOD OF PRODUCING SAME

BACKGROUND OF THE INVENTION

1. Field of the Invention

The invention relates generally to speaker enclosure devices, and relates specifically to an apparatus for re-radiating the sound emanating from a speaker enclosed and supported therein.

2. Description of the Prior Art

Presently known speaker enclosures include rigid walls, which absorb the sound radiating from the back of the speaker. Back of speaker sound is out of phase with respect to the sound radiating from the front of the speaker, and would, if not absorbed or modified, cancel at low frequencies, and interfere at high frequencies, with the sound radiating from the front of the speaker. Such presently known speaker enclosures can waste half of the sound being produced by the speaker, specifically the sound radiating from the back of the speaker.

Further, other presently known speaker enclosures, such as bass reflex systems, isolate the back of speaker sound wave, in low frequencies, by tuning the enclosed volume of air through a reflex opening to a resonant frequency. The indirect pressure emitted from the reflex opening undergoes a phase displacement such that it intensifies the front wave. Such enclosures are effective over less than half an octave around the resonant frequency, and provides little additional sound radiation beyond that provided by the enclosure without the reflex opening at other frequencies.

Sound, as recorded, includes two components, the "direct" sound, which reaches the microphones directly from the primary sound source, and "apparent" sound, which reaches the microphones from all other locations. The sound which is reproduced then includes such two components of the sound field, the direct and apparent sound, which originated from locations that are different from each other.

The apparent sound includes reverberant sound from the environment boundaries, and ambient sounds. The listener listens for reverberant and ambient sounds which occur at certain expected points in time, and excludes those which occur later or sooner. Apparent sound, by virtue of such difference in location with respect to direct sound, is not effectively reproduced by stereo speakers.

In professional sound environments, as a professional studio, the room is generally small. Rooms of small size have generally poor acoustic properties, as they do not provide sufficient reverberation time for the reverberant portion of the sound. To get longer reverberations time, a larger room is required, but large rooms are not convenient for operational reasons.

In home sound environments, a listening room is not designed with acoustics in mind, and such rooms also have generally poor acoustic properties.

Presently known speaker enclosures do not affect the boundaries of the sound listening environment and do not accurately reproduce and radiate apparent sound. Further, such enclosures "waste" the apparent sound that is available in the stereo program material.

SUMMARY OF THE INVENTION

In view of the above, an object of the invention is to provide an apparatus for re-radiating biphase sound radiating from a speaker enclosed and supported therein, for obtaining increased apparent sound from the speaker and for increasing the utilization of more of the sound generated by the speaker, specifically the back of speaker sound.

It is a further object to provide an improved speaker enclosure capable of radiating sound energy over a spectrum of from 50 Hz through 10 KHz with improved efficiency.

It is an additional object to provide an improved speaker enclosure that controls the shape of the sound radiation into the environment and which acts as a larger secondary sound source.

The above objects, as well as others, are provided for in the invention by means of an apparatus for re-radiating biphase sound radiating from a speaker enclosed and supported therein, which, when connected to receive a differential sound signal, enables the re-radiating sound to complement the direct sound radiating from stereo speakers.

The apparatus includes means for re-radiating the sound radiating from the back of the speaker to enable increased apparent sound to be obtained from the speaker and to prevent wasting the half of the sound energy that emanates from the back of the speaker.

The back speaker sound re-radiating means are comprised of a compliant material, such that at low frequencies the entire enclosure expands and contracts with the movement of the speaker diaphragm, responsive to volume expansion and contraction of the air enclosed in the means. The enclosure material is provided with portions that, at high frequencies, expand and contract locally in response to sound wavefront radiation from the speaker diaphragm. Such compliant material enables the enclosure to act as a radiator, producing a wavefront shape to conform to the shape of the entire means at low frequencies, and of the portions of the means at high frequencies such that the wavefront is in a desired shape to be radiated into the listening environment. For enhancing the perception of a more realistic sound, the apparatus further includes means for connecting the apparatus to a stereo source so as to obtain a difference signal to drive the apparatus to add phase information to the sound produced from the "left" and "right" stereo channels.

DESCRIPTION OF THE DRAWINGS

The invention is illustrated, by way of example thereof, in the accompanying drawings, wherein:

FIG. 1 is a perspective partly-broken view of a biphase sound re-radiating apparatus, pursuant to the invention;

FIG. 5 is a side elevational view of a speaker enclosure, with the sound radiation pattern in the low frequency range represented thereon;

FIG. 6 is a side elevational fragmentary view of a panel and wavefront transmitting portion, with the sound radiation pattern in the high frequency range represented thereon;

DESCRIPTION OF THE PREFERRED EMBODIMENT

In the preferred embodiment, the invention comprises, for example, a speaker enclosure 8 for re-radiating biphase sound radiating from a speaker A supported therein, adapted to enable the re-radiating sound to complement the direct sound radiating from right and left channel stereo speakers, as B, B′, as illustrated in FIGS. 1–3, 7 and 8.

Figure 2:
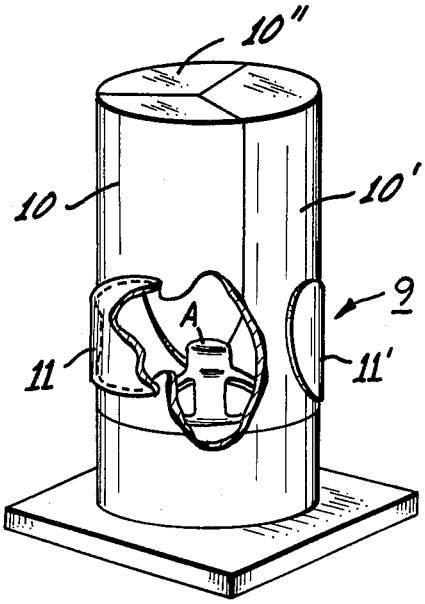
FIG. 2 is a perspective partly-broken view of a cylindrically shaped speaker enclosure, in one embodiment of the invention.
Figure 3:
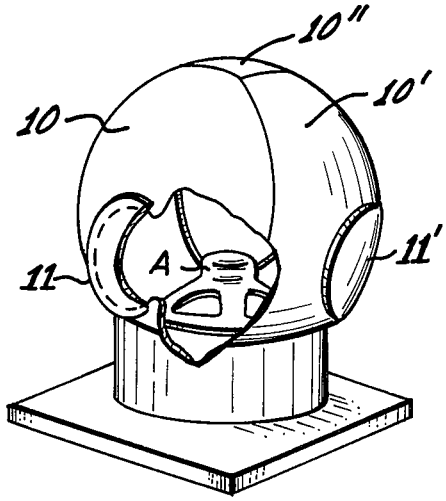
FIG. 3 is a similar view of a spherically shaped speaker, in another embodiment of the invention.

The apparatus 8, as illustrated in FIGS. 1–3, comprises means for re-radiating sound emanating from the back of the speaker, means for re-radiating sound emanating from the front of the speaker, means for screening sound re-radiating from the front and back of the speaker, and, in particular environment enhancing applications, means for connecting the apparatus to a stereo amplifier so as to obtain a difference signal. The apparatus 8 further includes means for supporting the front and back of speaker sound re-radiating means.

The back of speaker sound re-radiating means, as illustrated in FIGS. 1–6, is comprised of compliant material, which in a preferred embodiment is expanded polystyrene. A cylindrical apparatus is shown in FIG. 2 while a spherical version is illustrated in FIGS. 1 and 3. It has been observed that such material has unique mechanical properties causing it to function generally in a non-linear manner. At low frequencies it obeys basic mechanical laws, generally, such as expansion and contraction of enclosure volume. However, at high frequencies it has the ability to permit small areas of the material to vibrate without a large amount of loss to adjacent sections. At higher audio frequencies, where the wavelength approaches the cell size of the foam, the sound energy is not efficiently transmitted and may be substantially absorbed, thereby imposing an upper frequency limit on the satisfactory operating range of the device.

Such material is substantially efficient in transmitting energy in its thickness dimension, while changing the shape of the wavefront with very little energy loss in transmission. The material is effective over a substantial plurality of octaves between the low audio frequencies up to 10 KHz to re-radiate back of speaker sound.

The back of speaker sound re-radiating means comprises a plurality of panels, 10, 10′, 10″, connectable to the speaker so as to extend about and enclose the back of the speaker. Each panel includes a higher frequency wavefront transmitting portion, as 11, 11′, and means for securing the plurality of panels 10, 10′, 10″ to each other.

Figure 4:
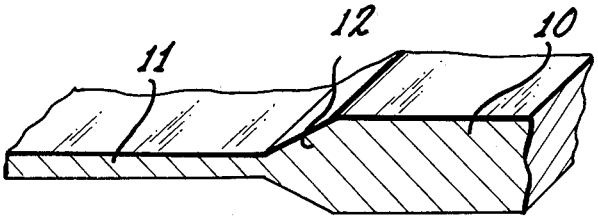
FIG. 4 is a side fragmentary cross-sectional view of a transition region between a panel and a wavefront transmitting portion thereof.

As illustrated in FIG. 4, adjacent to each wavefront transmitting portion 11 is a thickness transition region 12 which includes a gradient transition from the thickness of the panel 10, to the thickness of the wavefront transmitting portion 11. Such wavefront transmitting portions 11 are thin enough to ensure their activity in the high frequency range.

The securing means preferably comprise an adhesive which is comprised of compliant elastomeric material. In a preferred embodiment, a silicone rubber adhesive is employed, such as General Electric RTV-108, which allows optimum expansion desired, and which has characteristic compliance over a wide range of temperatures, from −20° C. to 100° C.

The front speaker sound re-radiating means include the supporting means, and means for diffusing the front speaker sound, which are connectable to the speaker so as to extend about the side portion of the front of the speaker. The supporting means comprise a base 20 to which is attached a diffuser 21.

A sound screening means may include a decorative grille 30 which extends about the front and back speaker re-radiating means and visually conceals the panels 10, 10′, 10″.

The speaker is connected to a stereo amplifier with conductors. When used as a conventional speaker it may be coupled to a left or right output channel. If the apparatus is to be used to complement the right and left stereo channels, a connection is made to obtain a difference signal using wires 40, 40′.

Figure 7:
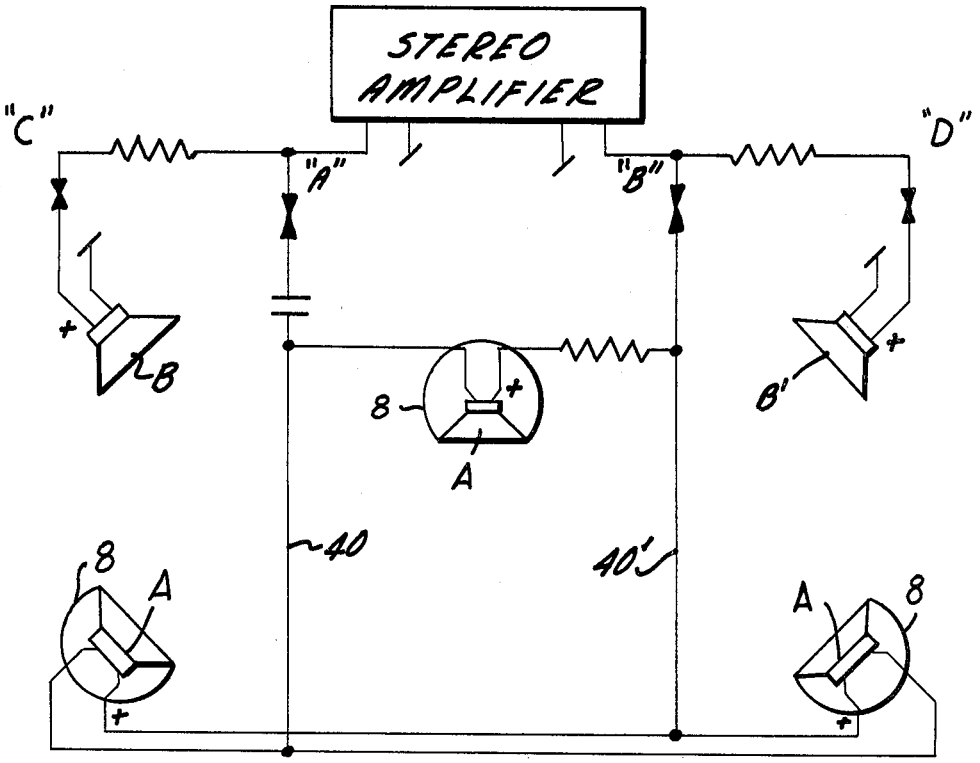
FIG. 7 is a schematic diagram of a plurality of speaker enclosures connected to a stereo amplifier and arranged in a small room along with conventional stereo speakers.

A plurality of speakers according to the present invention may be arranged in a particular listening environment to provide maximum effectiveness. However, for effective high frequency sound higher than 10 KHz, separate tweeters should be provided. In a small room, the apparatuses may be arranged as illustrated in FIG. 7, specifically at the boundaries of the listening environment and between the speakers connected to the stereo channels, so as to provide a substantially uniform apparent sound field. The apparent or echo sound field apparatuses are connected to the positive terminals of the channels of the stereo amplifier by wires 40, 40′ obtaining the difference signal therefrom to drive such apparatuses.

Figure 8:
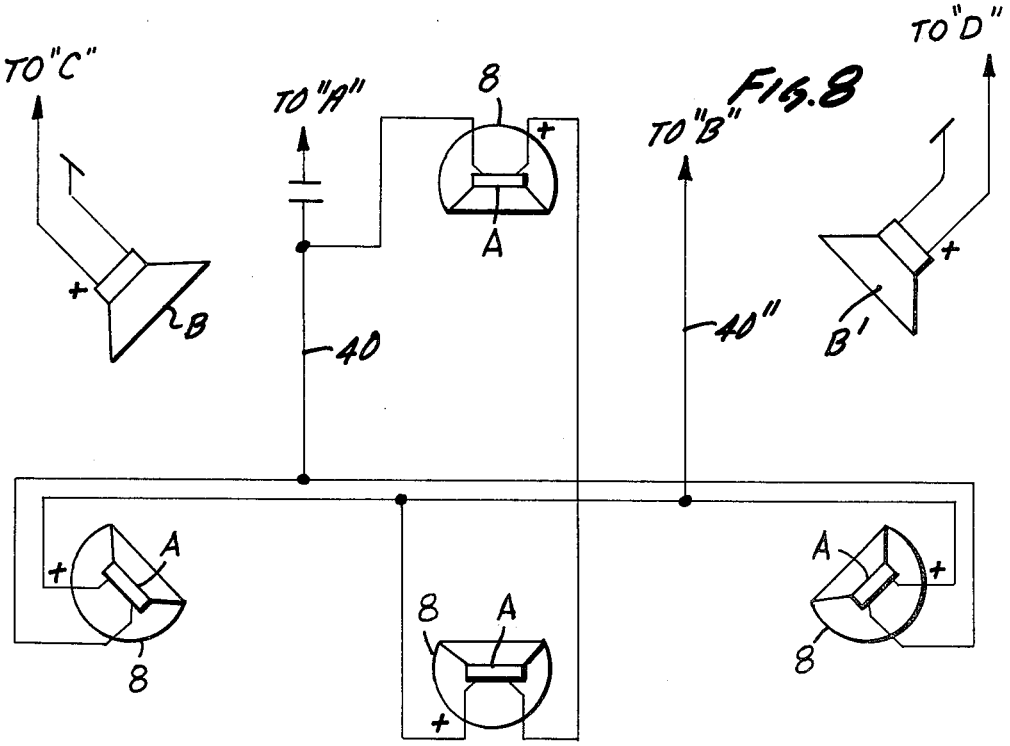
FIG. 8 is a schematic view of a plurality of speaker enclosures connected to a stereo amplifier and arranged in a large room along with conventional stereo speakers.

In a large room, the echo field apparatuses may be arranged as in FIG. 8, at the boundaries of the listening environment and between the stereo speakers B, B′, so as to provide a uniform apparent sound field therein for the sound re-radiating therefrom. As in FIG. 7, the echo field apparatuses may be connected to the positive terminals of the channels of the stereo amplifier by wires 40, 40′, so as to obtain the difference signal therefrom to provide the power necessary for driving the apparatuses. When the enclosures of the present invention are used as the primary right and left channel sound sources, additional high frequency speakers may be necessary to supply the audio frequencies above 10 KHz.

When the speakers according to the present invention are connected at low frequencies, below 1 kHz, the back of the speaker moves back and forth, creating air pressure changes therein, as illustrated in FIG. 5, which result in volume change responsive to air pressure excursions which are created by the movement the speaker diaphragm. The compliant material in the panels 10, 10′, 10″, the wavefront transmitting portions, as 11, 11′, and the adhesive between the panels expands and contracts with air pressure changes to accommodate such volume expansion.

There is a high degree of efficiency of coupling of the sound wavefront to the impedance of the surrounding air in the listening environment, so that there is little waste of energy in such transmission.

The wavefront of re-radiated sound assumes the shape of the back of speaker sound re-radiating means, which can be contoured as desired for the specific objective in re-radiating the biphase and apparent sounds into the listening environment. The most desirable shape is believed to be spherical, which generates an omnidirectional uniform sound field. Other shapes, such as cylindrical or elliptical, can be useful for specific acoustic problems.

The expanded polystyrene material does not have measurable leakage of energy therefrom. Even with the small air leakage about the enclosure at the edges of the speaker, the entire system has an air leak rate of less than 1% of the period of the lowest frequency propagated, which may be considered substantially airtight. Virtually all sound energy generated from the speaker diaphragm is then radiated into the room.

At high or audio frequencies, as about 1 kHz, the high frequency wavefront transmitting portions 11, 11' become active and generate the high frequency wavefront pattern, as illustrated in FIG. 6, while the remaining portions of panels 10, 10', 10'' and adhesive between the panel sections are relatively inactive. Each transmitting portion 11, 11' becomes a source of back of speaker sound and re-radiates the sound in a predetermined pattern consistent with the radiation pattern of the lower frequencies.

The front speaker sound re-radiating means function to reflect such front speaker sound off the base 20 and through the diffuser 21, such that such wavefront pattern "fits" into the phase and pattern of, and is re-radiated along with, the back of speaker sound. The grille 30 functions to protect the panels 10, 10', 10'' and is transparent to the sound re-radiating from the front and back speaker portions.

Enclosures according to the present invention provide enhanced sound generation in the low through mid frequency range (up to 10 KHz) and, depending upon the sound source, can enable increased apparent sound to be obtained from the speakers or increased stereo right and left channel sound. The portion of the sound emanating from the speakers, specifically the back of speaker sound, is supplemented by the rephased front of speaker sound, thereby using more of the sound energy produced by the speaker. The compliant material is shaped to select the wavefront to be formed and radiated into the listening environment.

The apparatuses when driven by a difference signal accurately reproduce the biphase and apparent sound, and enable control of the acoustic boundaries of the listening environment by complementing the direct sound from stereo speakers.

An additional discovery of the present invention is the unique response of the expanded polystyrene material to the acoustic waves. The material appears to exhibit nonlinear mechanical properties and is especially suited to function as a broad band resonator.

Manufacturing techniques may permit molding of the enclosure in a single step. However, it is frequently simpler to form the panels and to join them later into the desired shape. Polystyrene is foamed in a mold, and the material best suited for the present application is fully foamed, with maximum open volume and lowest density.

As noted above, at the lower frequencies, the entire enclosure expands and contracts with the changes in air pressure produced by the excursions of the speaker diaphragm. At the higher frequencies, however, it is the thinner, small panel portions that are driven and resonate by the shorter, higher frequency acoustic waves. Frequencies above 10 KHz have a fractional wavelength that is short enough to approach the magnitude of very small groups of individual cells which then resonate, independently. At these higher frequencies, the expanded polystyrene foam material begins to absorb the acoustic energy.

In the audio frequency range up to 10 KHz, the material can be as high as 90% efficient in transmitting energy to the environment. The material resonates in areas that are related to the wavelength of the applied audio waves. As the waves become shorter, thinner sections of smaller area resonate and with appropriate design, a panel can act as a mechanical, crossover network.

Accordingly, a new use for expanded polystyrene has been disclosed. The new use is a substantially airtight speaker enclosure which is capable of reradiating sound energy applied to the interior of the enclosure in a predetermined pattern, determined by the shape of the enclosure. Spherical enclosures radiate spherical waves; and a cylindrical enclosure generates a substantially uniform, cylindrical pattern. By providing thinner sections of appropriate wall shape, radiators of acoustical energy at higher frequencies are achieved.

The preferred embodiment of the invention has been set forth above. It is to be understood, however, that variations may be made in such preferred embodiment, which variations may nevertheless be within the scope and spirit of the invention. The invention, therefore, is to be broadly construed within the scope and spirit of the claims herein.

I claim:

1. An improved speaker enclosure for re-radiating biphase sound radiating from a speaker supported and enclosed therein, comprising speaker mounting and enclosing means for combining and re-radiating back and front of speaker sound in a predetermined radiation pattern, back of speaker sound re-radiating means comprised of compliant material, said sound re-radiating means comprising a plurality of substantially airtight panels, connectable to a speaker so as to extend about and enclose the speaker in substantially airtight relationship, each panel including a high audio frequency wavefront transmitting portion, and means for elastically sealing and securing the plurality of panels to each other.

2. An apparatus as in claim 1, in which the securing means comprise a compliant adhesive material in the nature of an elastomer.

3. In combination with a stereo system having right and left audio channels, an improved speaker enclosure comprising:

(1) means for supporting a speaker capable of generating sound when coupled to an audio channel;
(2) foamed polystyrene panels in a desired shape for sound re-radiation;
(3) elastomeric adhesive means for combining said panels in said desired shape;
(4) means for nondestructively combining front and rear of speaker sound generated by a speaker supported within said enclosure;

whereby acoustical energy generated by a supported speaker is re-radiated by said enclosure in a desired radiation pattern.

4. The enclosure of claim 3, above, wherein said panels act as a sound resonator for audio frequencies below 1 KHz.

5. The enclosure of claim 3 above, wherein said panels include shaped, thinner-walled portions capable of resonating audio frequencies between 1 KHz and 10

KHz, for radiating acoustical energy between 1 KHz and 10 KHz in said desired pattern.

6. The enclosure of claim 3, above, including means for coupling the speaker to receive one of the right and left audio channels.

7. The enclosure of claim 3, above, including means for coupling the speaker to receive a signal representing the difference between right and left audio channels.

8. A new use of expanded polystyrene foam comprising the method of use steps of:

(1) fully foaming in place panels adapted to be joined in a substantially airtight, speaker enclosure;

(2) joining said panels into a speaker enclosure with an elastomeric adhesive;

(3) mounting a speaker in said enclosure in a substantially airtight relationship;

(4) driving said speaker at audio frequencies, below 10 KHz, whereby said enclosure is capable of reradiating audio sound waves in a desired radiation pattern.

9. The new use of expanded polystyrene foam of claim 8 above wherein the foaming step includes providing thinner-walled portions in selected areas of said panels whereby said thinner-walled portions are capable of radiating acoustic frequencies substantially from 1 KHz to 10 KHz, said panels being capable of radiating acoustic frequencies up to 1 KHz.

* * * * *